US010731357B2

(12) United States Patent
Bolin

(10) Patent No.: US 10,731,357 B2
(45) Date of Patent: Aug. 4, 2020

(54) VENTILATED THIN BRICK PANEL SYSTEM

(71) Applicant: Joel W Bolin, Hempstead, TX (US)

(72) Inventor: Joel W Bolin, Hempstead, TX (US)

( * ) Notice: Subject to any disclaimer, the term of this patent is extended or adjusted under 35 U.S.C. 154(b) by 0 days.

(21) Appl. No.: 16/112,923

(22) Filed: Aug. 27, 2018

(65) Prior Publication Data

US 2020/0063438 A1 Feb. 27, 2020

(51) Int. Cl.

| | |
|---|---|
| ***E04F 13/08*** | (2006.01) |
| ***E04F 13/14*** | (2006.01) |
| ***E04F 13/00*** | (2006.01) |
| ***E04B 2/32*** | (2006.01) |

(52) U.S. Cl.

CPC ..... *E04F 13/0862* (2013.01); *E04B 2/32* (2013.01); *E04F 13/007* (2013.01); *E04F 13/0869* (2013.01); *E04F 13/0871* (2013.01); *E04F 13/0885* (2013.01); *E04F 13/144* (2013.01); *E04F 13/147* (2013.01)

(58) Field of Classification Search

CPC . E04F 13/0862; E04F 13/0885; E04F 13/007; E04F 13/0871; E04F 13/0869; E04F 13/144; E04F 13/147; E04B 2/32

See application file for complete search history.

(56) References Cited

U.S. PATENT DOCUMENTS 658,868 A * 10/1900 Rosenbaum ..... E04F 13/0862 220/DIG. 3
948,160 A * 2/1910 Cesinger ..... E04F 13/147 52/276
1,106,168 A * 8/1914 Thomas ..... E04F 13/0862 52/387
2,043,706 A * 6/1936 Myers ..... E04F 13/0803 52/387
2,054,511 A * 9/1936 Hornicek ..... E04F 13/0803 52/385
2,101,612 A * 12/1937 Duffy ..... E04F 19/06 52/386
3,533,206 A * 10/1970 Passeno, Jr. ..... E04F 13/08 156/71
4,238,915 A * 12/1980 Yoshida ..... E04F 13/0801 52/386
4,809,470 A * 3/1989 Bauer ..... E04F 13/0801 52/105
4,856,245 A * 8/1989 Osawa ..... E04F 13/0832 52/386
4,916,875 A * 4/1990 Kashiwagi ..... E04F 13/0851 52/302.3
4,987,712 A * 1/1991 Mancuso ..... E04F 13/0862 52/387
5,006,011 A * 4/1991 Hiyashi ..... E01C 5/001 404/37
5,501,049 A * 3/1996 Francis ..... E04F 13/0862 52/315
5,958,306 A * 9/1999 Curtis ..... F28F 25/02 261/112.2
6,802,165 B1 * 10/2004 Passeno ..... E04F 13/0862 52/288.1

(Continued)

*Primary Examiner* — Jessie T Fonseca
(74) *Attorney, Agent, or Firm* — Jones Walker LLP

(57) ABSTRACT

A panel for a thin brick system comprises repeating and aligned peaks and valleys, with individual ledges associated with each valley, with at least a portion of each ledge protruding above an adjacent peak to provide a surface to support a product, such as a thin brick on the peaks of the panel.

18 Claims, 3 Drawing Sheets

FIG. 7

(56) References Cited

U.S. PATENT DOCUMENTS

| | | | | |
|---|---|---|---|---|
| 8,122,683 | B1 | 2/2012 | Schwalenberg | |
| 8,935,896 | B2 | 1/2015 | Tancredi et al. | |
| 9,464,442 | B1 | 10/2016 | Olczyk et al. | |
| 9,556,618 | B2 * | 1/2017 | Streicher | E04F 13/14 |
| 9,828,770 | B2 * | 11/2017 | Tipping | E04C 2/324 |
| 10,138,635 | B1 * | 11/2018 | Yeo | E04F 13/0819 |
| 2004/0255533 | A1 * | 12/2004 | Koester | E04B 1/70 52/302.1 |
| 2008/0222986 | A1 * | 9/2008 | Hamel | E04F 13/147 52/415 |
| 2008/0260993 | A1 * | 10/2008 | Koester | E04B 1/70 428/131 |
| 2011/0023398 | A1 * | 2/2011 | Ismay | E04F 13/0807 52/483.1 |
| 2013/0247495 | A1 * | 9/2013 | Tancredi | E04F 13/0862 52/479 |
| 2014/0260050 | A1 * | 9/2014 | Calmes | E04F 13/147 52/561 |
| 2016/0160497 | A1 * | 6/2016 | Randlett | E04F 13/007 52/61 |
| 2017/0121976 | A1 * | 5/2017 | Neumayr | E04C 2/525 |
| 2018/0038103 | A1 * | 2/2018 | Neumayr | E04B 1/14 |

* cited by examiner

2/3

VENTILATED THIN BRICK PANEL SYSTEM

CROSS REFERENCE TO RELATED APPLICATIONS

Not applicable.

STATEMENT REGARDING FEDERALLY SPONSORED RESEARCH OR DEVELOPMENT

Not applicable.

REFERENCE TO APPENDIX

Not applicable.

BACKGROUND OF THE INVENTION

Field of the Invention

The inventions disclosed and taught herein relate generally to thin brick systems for buildings and structures.

Description of the Related Art

Bricks can be used in construction of buildings as structural, load bearing elements, or as non-loading bearing elements. In today's construction industry, bricks are typically used as non-load bearing elements, such as exterior siding, interior walls, or ceilings. Even when used in non-load bearing applications, laying brick can be expensive and time consuming. Several solutions have been proposed, each with differing degrees of success.

For example, U.S. Pat. No. 8,935,896, owned by Glen-Gery Corporation and entitled Masonry Support Panel and Associated Methods of Use, purports to disclose "A support panel for masonry objects may include an inner surface, an outer surface, at least one stiffening channel formed longitudinally along the support panel, and a plurality of substantially C-shaped tabs extending from the outer surface, the tabs being disposed in spaced apart relation to one another to form a grid, wherein the tabs are configured to contactingly support at least a portion of a masonry object."

Also, U.S. Pat. No. 9,464,442, owned by Stone Master SA and entitled Wall Cladding Assembly Method and System, purports to disclose "A wall cladding assembly is disclosed. The wall cladding assembly includes a wall cladding tile having a substantially flat surface, a mounting channel attached to the flat surface and at least one anchor secured to the mounting channel. The mounting channel includes a planar base plate, a pair of flanges along parallel edges is of the base plate and a pair of lips at outer edges of the flanges. The base plate, the flanges and the lips define a first recess and a second recess. The at least one anchor includes an anchor plate and a pair of projections extending from the anchor plate. A first projection has a first securing lip and a second projection has a second securing lip, the first securing lip having a portion sized to fit in the first recess and the second securing lip having a portion sized to fit in the second recess."

U.S. Pat. No. 8,122,683, entitled Support Panel for Thin Brick, purports to disclose "A support panel for thin brick, comprising a metal sheet, an array of groove retaining tabs having first tab edges, said first tab edges protruding from said sheet having at an upward angle of less than about 45 degrees, for a distance of less than about one quarter inch, and an array of mortar lock tabs having second tab edges, said second tab edges protruding from said sheet at a downward angle of greater than about 45 degrees, said array of mortar lock tabs being offset vertically from said array of groove retaining tabs, wherein, said array of groove retaining tabs are adapted to engage shallow dovetail grooves formed in the rear of thin bricks, and said mortar lock tabs are adapted, when embedded within a cured mortar matrix, to exert, in response to a tensile force away from said metal sheet, a force along a vertical axis, on the brick, in an opposite direction to a force applied to the brick along a vertical axis by said groove retaining tab, to thereby retain the brick against the panel."

The inventions disclosed and taught herein are directed to an improved thin brick panel system that reduces both cost and time, while providing superior performance.

BRIEF SUMMARY OF THE INVENTION

A non-limiting summary of the nature and substance of at least one of the inventions is taught herein is: A thin brick panel system, comprising a panel having front side and a back side, and a repetitive pattern of aligned peaks and valleys; a series of ledges configured such that at least a portion of each ledge extends beyond the adjacent peak, the portions configured to support a thin brick; a first ventilation path established on the back side by the peaks; and a second ventilation path established on the front side by the valleys. A panel may comprise a ledge vent formed under each ledge and defining a third ventilation path transverse to the first and second ventilation paths. The ledges may formed from valley material. The panel may comprise corrugated sheeting, such as corrugated metal sheeting. The ledges may be formed by a punching operation. Thin bricks or similar products may be supported by the ledges and secured to the peaks, such as with an adhesive. The panels may have a plurality edge slots configured to mate with ledges on a second panel to form a smooth transition between adjacent panels.

These brief summaries of the inventions are not intended to limit or otherwise affect the scope of the appended claims, and nothing stated in this Brief Summary of the Invention is intended as a definition of a claim term or phrase or as a disavowal or disclaimer of claim scope or dedication of an invention disclosed herein.

BRIEF DESCRIPTION OF THE SEVERAL VIEWS OF THE DRAWINGS

The following figures form part of this disclosure and are included to demonstrate further certain aspects of the present inventions. The inventions may be better understood by reference to one or more of these figures in combination with the detailed description of specific embodiments presented herein.

Figure 1:
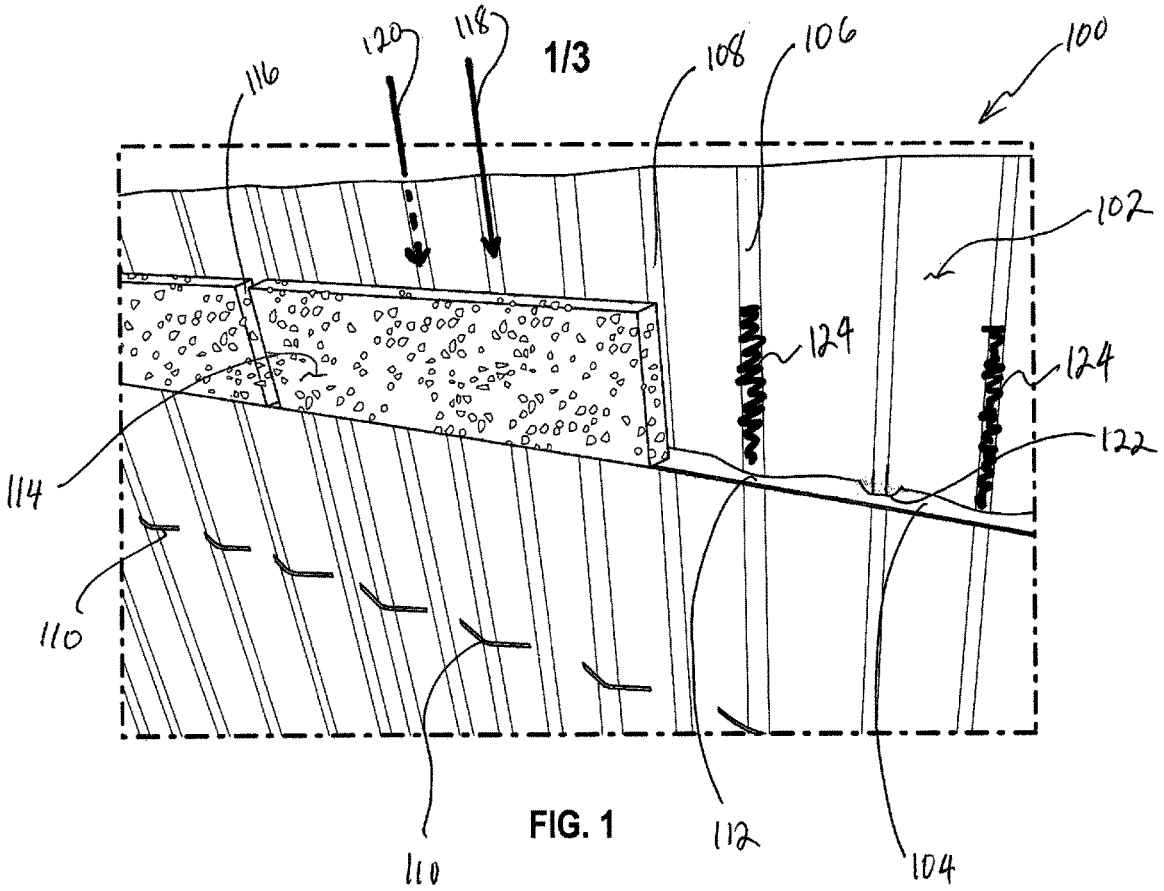
FIG. 1 illustrates one of many possible embodiments of a thin brick panel system according to aspects of the present inventions.

While the inventions disclosed herein are susceptible to various modifications and alternative forms, only a few specific embodiments have been shown by way of example in the drawings and are described in detail below. The figures and detailed descriptions of these specific embodiments are not intended to limit the breadth or scope of the inventive concepts or the appended claims in any manner. Rather, the figures and detailed written descriptions are provided to illustrate the inventive concepts to a person of ordinary skill in the art and to enable such person to make and use the inventive concepts.

DETAILED DESCRIPTION

The Figures described above and the written description of specific structures and functions below are not presented to limit the scope of what Applicants have invented or the scope of the appended claims. Rather, the Figures and written description are provided to teach any person skilled in the art to make and use the inventions for which patent protection is sought. Those skilled in the art will appreciate that not all features of a commercial embodiment of the is inventions are described or shown for the sake of clarity and understanding. Persons of skill in this art will also appreciate that the development of an actual commercial embodiment incorporating aspects of the present inventions will require numerous implementation-specific decisions to achieve the developer's ultimate goal for the commercial embodiment. Such implementation-specific decisions may include, and likely are not limited to, compliance with system-related, business-related, government-related, and other constraints, which may vary by specific implementation, location and from time to time. While a developer's efforts might be complex and time-consuming in an absolute sense, such efforts would be, nevertheless, a routine undertaking for those of skill in this art having benefit of this disclosure. It must be understood that the inventions disclosed and taught herein are susceptible to numerous and various modifications and alternative forms without departing from the scope of the inventions disclosed herein. Lastly, the use of a singular term, such as, but not limited to, "a," is not intended as limiting of the number of items. Also, the use of relational terms, such as, but not limited to, "top," "bottom," "left," "right," "upper," "lower," "down," "up," "side," and the like are used in the written description for clarity in specific reference to the Figures and are not intended to limit the scope of the invention or the appended claims.

I have created a thin brick panel system providing improved ventilation under the thin bricks, under the thin brick panel, and, optionally, transversely along the thin brick panel. It is presently preferred that the thin brick panel comprises a sheet that has a repetitive pattern of peaks and valleys. For example, but not limitation, corrugated sheeting, such as corrugated roofing sheets or panels, may be used as part of the thin brick panel system disclosed herein. As will be understood by those of skill in the art, most sheets of corrugated roofing are about 26 inches wide by about 8 feet long. These dimensions are suitable for thin brick panel systems for is use in most commercial and residential construction efforts. Other size panels are also contemplated for use with these inventions.

An undulating panel of crests and valleys can be secured to a structure, such as a wall or ceiling, through conventional means, such as threaded fasteners or other systems. A construction or ornamental product, such as, but not limited to a thin brick product, such as those available from Summitville Tiles, Inc., of Summitville, Ohio, may be secured to the undulating panel. Typically, thin bricks are 2-¼ inches by 7-⅝ inches by 9/16 inch, but any size systems. A construction or ornamental product can be used with the inventions disclosed herein, even products of varying size and shape. For purposes of this disclosure, I will use the label "thin bricks" to refer to that broad class of construction and/or or ornamental products, including, but not limited to, thin bricks, man-made stone, and natural stone, that are used as a veneer for exterior and/or interior purposes.

The thin bricks may be secured to panel, such as by gluing, cementing or otherwise adhering at least a portion of the backside of the brick to the undulating panel. It is preferred, but not required, that an elastic and waterproof adhesive, such as Seal Bond 105 available from the Seal Bond company of Springlake, Mich., be laid along the crests of the undulating panel and the thin brick pressed into the adhesive to secure it to the panel.

It will be appreciated that an aspect of my invention is the use of a horizontal ledge or bottom support system that aligns and/or supports each thin brick or product while it is being secured to the panel system. A ledge system allows the bricks to be spaced at the desired location while keeping a consistent or predetermined horizontal alignment.

By securing the bricks to the crests of the undulating panel, a gap between the backside of the brick and the valley of the undulating panel is established, which gap aids in the ventilation, is such as transporting moisture away from the brick system and the building. Similarly, the backside of the panel establishes a ventilation path between the structure and the crest of the undulating panel, which provides ventilation between the panel system and the building.

In addition to providing ventilation, the ventilation path established by the backside of the panel (established by the crests) also can serve as a pathway or chase for electrical, audio/visual, security or other systems.

One of many possible embodiments of a ledge system/bottom support for use with an undulating panel comprises a strip of material that can be placed into horizontal slots formed in the crests of the undulating material. In this embodiment, the thickness of the strip material is such that when compared to the depth of the slot, a portion of the ledge material extends beyond the crest. It will be appreciated that this portion of ledge material extending above the crest forms the ledge upon which the thin brick rests while it is being secured to the panel system. It will also be appreciated that the ledge system can be remove, such as prior to mortaring, from under a particular row of thin bricks after the thin bricks have adhered to the panel, and the ledge system re-used for a different row.

Other embodiments of ledge system may include a timing element that engages with a structure of the panel, such as a valley of the panel, so that the spacing between bricks can be timed or synchronized to provide the desired visual appearance. Embodiments of the ledge system may also comprise spacers such as transverse mortar gap spacers that set off the ends of each brick one from the other to establish a consistent or varied, if desired, transverse mortar spacing between bricks.

A preferred embodiment of the panel system comprises an undulating panel system, such as corrugated metal sheeting or corrugated composite sheeting (e.g., corrugated fiberglass, is composite or plastic panels). The conventional sheeting is modified by producing from valley material an individual ledge that extends outward in the direction of the crest and exceeds by an amount a height of the crest. It will be appreciated that this loop or portion of panel material establishes a ledge upon which a portion of the brick may rest while it is being secured to the panel system. For metal corrugated sheeting, a punch-type fabrication operation can be employed to create these loop ledges in rapid fashion in large panel sheet. Other processes are available for creating similar ledges from nonmetallic corrugated panel systems. It is also contemplated that individual ledges can be integrated into the corrugated material, such as by flash or resistance welding or other type of joining processes.

To the extent the panel system will encounter ground contact, a lowermost portion of the panel may be coated, such as with an elastomeric roofing compound, to protect against corrosion or other degradation of the panel caused by ground contact or moisture.

A surprising and unexpected benefit of creating ledges from valley material of the corrugated panel is the creation of a transverse ventilation path. Unlike conventional Veneer panel systems, the panel systems of the present disclosure may benefit from three levels of ventilation: 1) ventilation behind the corrugated panel in the direction of the corrugations; 2) ventilation in front of the panel between the valleys and the bricks in the direction of the corrugations; and 3) ventilation through the ledge slots transversely to the corrugations. It will be appreciated by those of skill in the art that this level of ventilation provides increased viability and/or longevity to thin brick panel systems and to the structures to which they are attached.

Turning now to the figures, FIG. 1 illustrates a thin brick panel system 100 comprising a panel 102 and a thin brick ledge 104. The panel 102 preferably comprises an repetitive series peaks or crests 106 and valleys 108. For example, and not limitation, corrugated sheeting, such is as galvanized corrugated sheeting, or composite corrugated sheeting, may be used as the panel 102. Ledge slots 110 are shown cut or formed into the crests 106 of the undulating panel 102, and are configured to receive the ledge 104 therein. The brick ledge 104 is illustrated to be placed partly in the slot 104, such that a portion 112 of the ledge 104 protrudes or extends beyond or above the crests 106.

As will now be appreciated, a thin brick 114 may be placed on the ledge 104 with a backside of the thin brick 114 making contact with one or more of the crests 106 of the panel 102. Thin bricks 114 may be secured to the panel crests 106. It is preferred, but not required, that an elastic, waterproof adhesive compound 124 be used to secure the thin bricks 114 to the panel 102, such as by placing adhesive 124 on the crests 106 and pressing the thin brick 114 to the panel 102 as the ledge portion 112 supports the thin brick. The elastic property of such adhesive allows the panel 102, such as a corrugated metal panel, to expand/contract with temperature changes without de-bonding the thin brick product 114. Also shown in FIG. 1 is a transverse mortar gap 116. Once the thin bricks 114 have been adhered to the panel 102 using the ledge 104, conventional mortar may be used to fill in the mortar gap 116 and the axial mortar gap between rows of bricks (not shown).

It will be appreciated that because of the undulating nature of the panel 102 an airflow or ventilation path 118 is established under the bricks 114 as illustrated in FIG. 1. Additionally, an airflow or ventilation path 120 behind the panel is also established.

Figure 2:
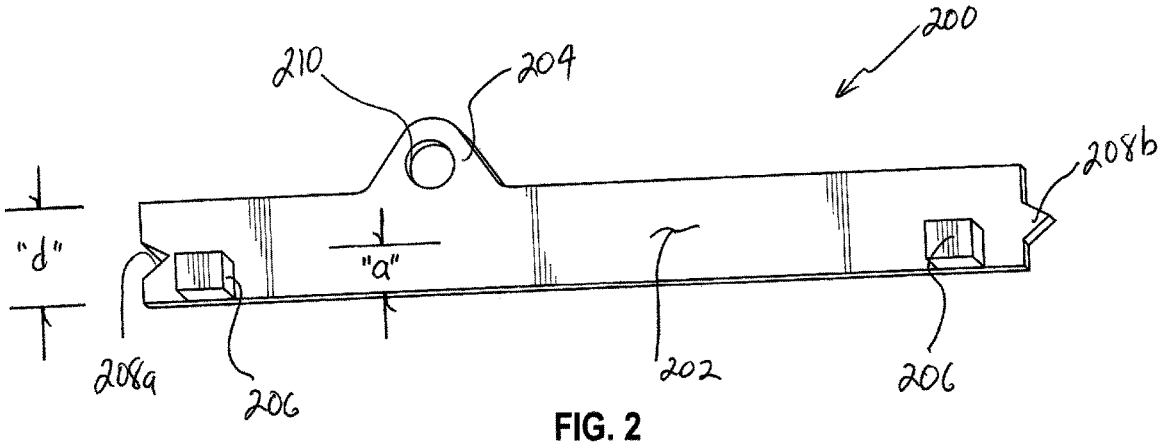
FIG. 2 illustrates one of many possible ledge systems for use with a thin brick panel system.

FIG. 2 illustrates one of many possible embodiments of a ledge system 200 for use with an undulating panel, such as that of panel 102. The ledge system 200 illustrated in FIG. 2 comprises a body 202 of predetermined length. Although FIG. 2 illustrates a relatively short length of ledge system 200, it will be appreciated that the length can be whatever is desired.

As illustrated in FIG. 2, it will be appreciated that the depth "d" of the ledge system 200 is configured such that a portion "a" of the ledge system extends above the crests 106 of the panel 102 so that the thin brick 114 can rest on that portion "a" of the ledge system. The ledge system 200 also may comprises transverse mortar gap spacers 206 that allow consistent transverse mortar gaps between each thin brick 114. As illustrated, it is preferred that the transverse mortar gap spacers 206 be formed in the portion "a" that supports the thin brick. Ledge system 200 also may comprise orienting linking elements 208*a* and 208*b* at each end of the body 202 to facilitate interconnection with the next ledge system 200.

Figure 3:
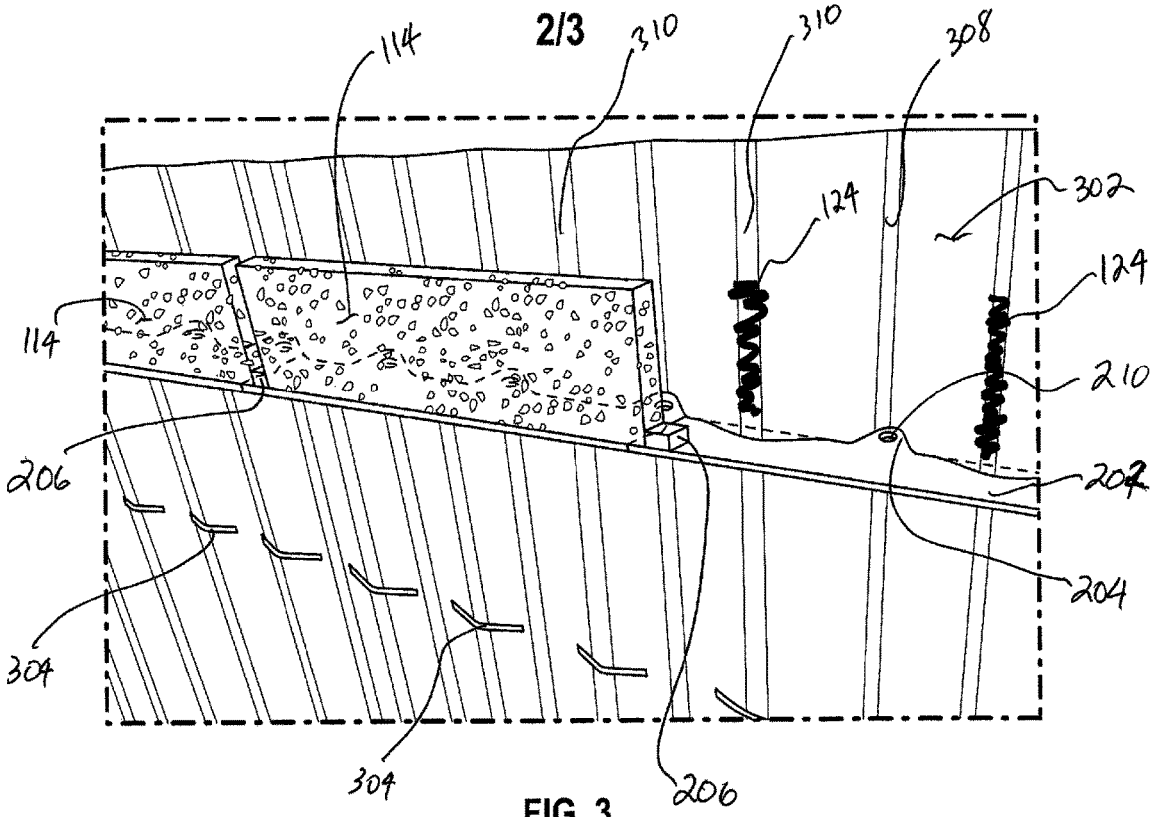
FIG. 3 illustrates a thin brick panel system utilizing the ledge system of FIG. 2.

It is preferred that ledge system 200 comprises a timing element 204, such as a tab or protrusion. As illustrated in FIG. 3, tab or protrusion 204 can reside in a valley 108 and therefore time or synchronize the transverse mortar gaps of bricks on one row to the bricks on a row above or below. Alternately, a transverse mortar gap spacer 206 may function as a timing element 204 by extending across the depth "d." In this type of embodiment, the elongated spacer can be aligned with a valley 108. It will be appreciated that by placing the timing element 204 in a different valley 108 for each successive row of bricks 114, the transverse mortar gaps 116 may establish the desired pattern.

Also illustrated in FIG. 2 is a vent 210 formed in the ledge 200, and specifically in the timing element 204. It will be appreciated that based on the size of the timing element 204, a vent 210 may be desired in the timing element 204 to not block airflow or ventilation through the valleys 108 as discussed above for FIG. 1. It will be appreciated that vents 120 likewise may be formed in ledge 104 illustrated in FIG. 1.

FIG. 3 illustrates a thin brick panel system 300 comprising an undulating panel 302 and is the ledge system 200 illustrated in FIG. 2. The panel 302 is illustrated with ledge slots 304 of sufficient width and depth to accept ledge system 200. Timing element 204 is shown positioned in a valley 308 of panel 302. Thin bricks 114 are shown supported by ledge system 200 between transverse gap spacers 206. In this embodiment, each thin brick 114 has been glued or otherwise secured to the panel 302 crests 310 through use of a conventional adhesive 124.

Figure 4:
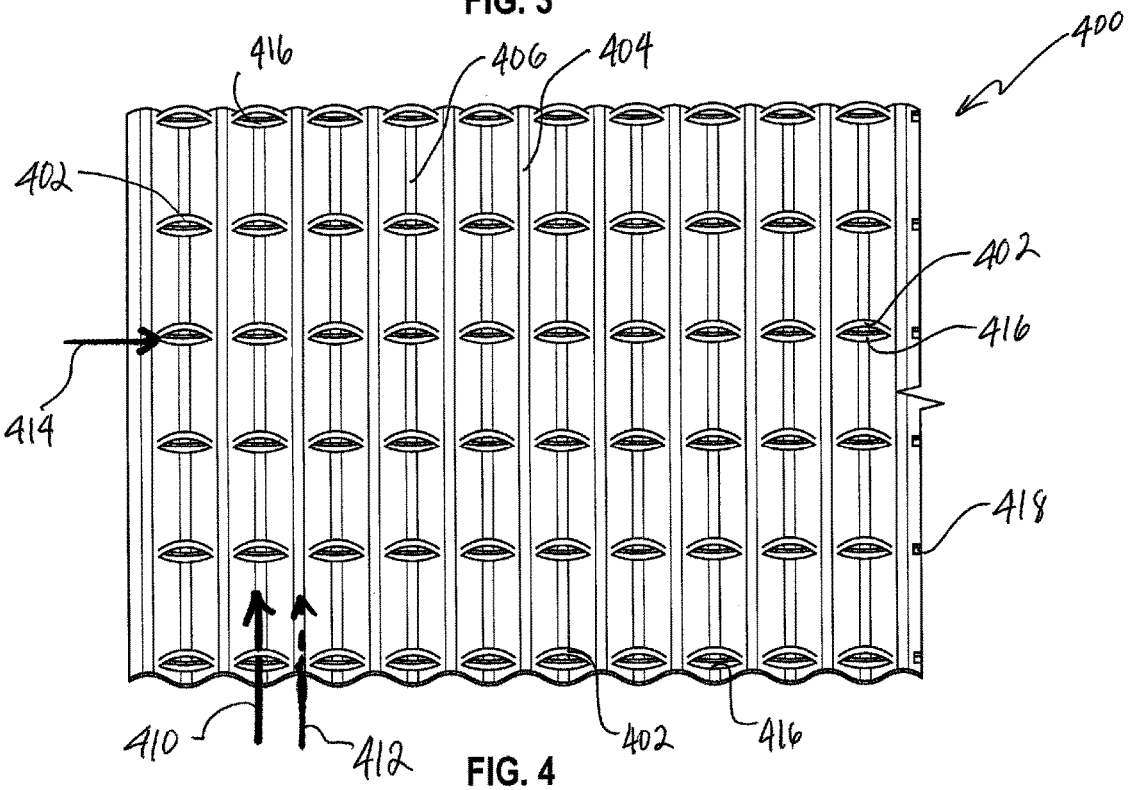
FIG. 4 illustrates another of the many possible embodiments of a thin brink panels system according to aspects of the present inventions.

FIG. 4 illustrates another of the many possible embodiments of the present invention. In FIG. 4, an undulating panel 400, such as but not limited to corrugated galvanized sheeting, has been modified by creating individual ledges 402 adjacent each panel crest 404. For example, a ledge 402 may be punched or otherwise created from a portion of the valley 406 material of panel 400. In the embodiment illustrated in FIG. 4, a loop of valley material 402 has been punched outward from the valley 406 such that the ledge 402 extends in the direction of the panel crests 404, and actually extends a distance beyond the panel crest 404.

It will be appreciated from FIG. 4 that the axial airflow path 410 along the valleys 406 of the panel is not compromised by formation of the ledges 402. Similarly, an airflow path 412 under the crests 404 of the panel 400 can also be established. In addition and in contrast to the embodiments in FIGS. 1-3, the embodiment of FIG. 4 allows a transverse airflow path 414 through the ledge openings 416 formed when creating ledges 402. Also shown in FIG. 4, are ledge slots 418, which are configured to nest with a portion of a ledge 402 from an adjacent panel system 400 (not shown).

Figure 5:
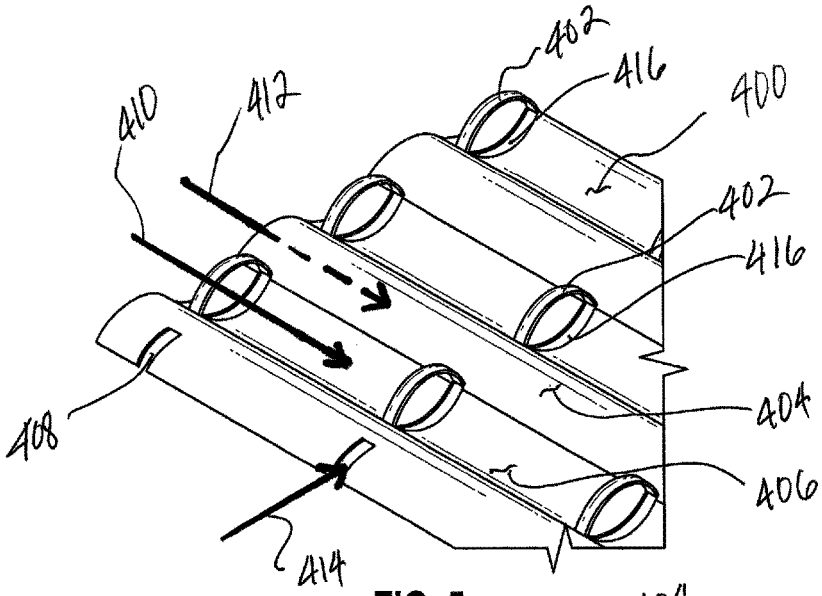
FIG. 5 illustrates a close-up view of a section of the panel system of FIG. 4.

FIG. 5 illustrates a close-up view of a portion of panel system 400 showing in greater detail the transverse airflow path 414 through vent slots 416 created by forming the ledges 402 from valley 406 material.

Figure 6:
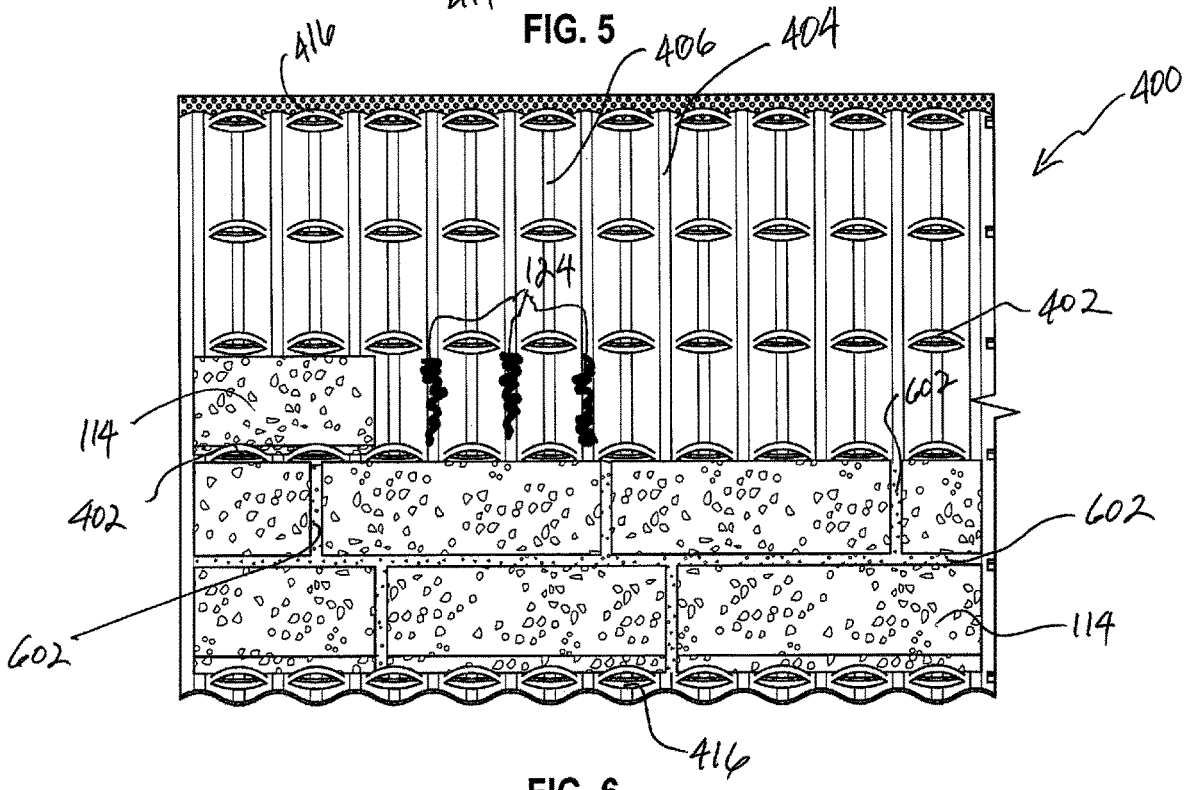
FIG. 6 illustrates the panel system of FIG. 4 partially completed with thin brick.

FIG. 6 illustrates the thin brick panel system 400 in use. A panel 400 may be secured to is a structure, such as sheathing on an exterior wall, with threaded fasteners or other devices. Thin bricks 114 are shown adhered to the panel system 400, preferably the crests 404 of the undulating panel. Each brick 114 rests on one or more individual ledges 402 to establish a consistent horizontal presentation. Each brick 114 may be spaced apart from its neighbor a fixed amount or a variable amount depending on the desired visual appearance. Once bricks 114 have been secured to the panel system 400, mortar 602 may be placed in the mortar gaps as is well known.

Figure 7:
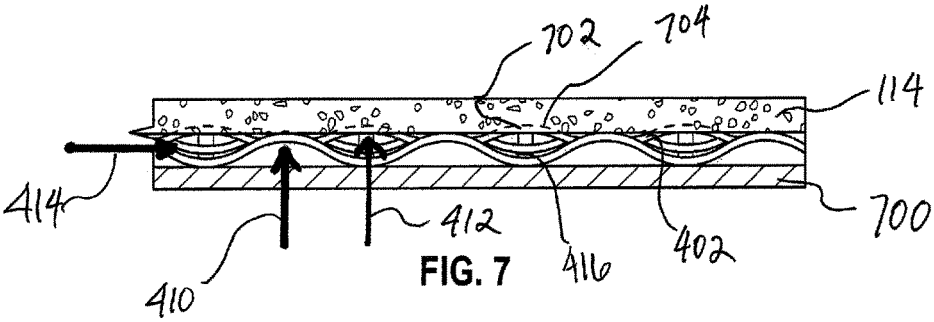
FIG. 7 illustrates an end view of the partially completed thin brick panel of FIG. 6.

FIG. 7 is an end view of the panel system shown in FIG. 6. The in view of FIG. 7 shows the under panel airflow path 412, and the under brick airflow path 410, and the transverse airflow path 414. The panel system 400 with thin brick 114 is shown secured to a substrate or backer 700 such as plywood, foam board, other construction material, or insulation.

Also illustrated in FIG. 7, is the relationship between the thickness of the thin brick (represented by outer surface 702) and the projection 702 of the ledge 402. It is preferred, but not required that ledge 402 not project the outer surface of the brick 114, and most preferably that the ledge only project as far as necessary to provide support for the brick 114 during construction (i.e., adhering the brick 114 to the panel 400). As can be seen from FIGS. 6 and 7, having minimal or optimized projection 704 allows for efficient and attractive mortaring of the bricks 114.

Other and further embodiments utilizing one or more aspects of the inventions described above can be devised without departing from the spirit of Applicant's invention. Further, the various methods and embodiments of the methods of manufacture and assembly of the system, as well as location specifications, can be included in combination with each other to produce variations of the disclosed methods and embodiments. Discussion of singular elements can is include plural elements and vice-versa.

The order of steps can occur in a variety of sequences unless otherwise specifically limited. The various steps described herein can be combined with other steps, interlineated with the stated steps, and/or split into multiple steps. Similarly, elements have been described functionally and can be embodied as separate components or can be combined into components having multiple functions.

The inventions have been described in the context of preferred and other embodiments and not every embodiment of the invention has been described. Obvious modifications and alterations to the described embodiments are available to those of ordinary skill in the art. The disclosed and undisclosed embodiments are not intended to limit or restrict the scope or applicability of the invention conceived of by the Applicants, but rather, in conformity with the patent laws, Applicants intend to protect fully all such modifications and improvements that come within the scope or range of equivalent of the following claims.

What is claimed is:

1. A panel system, comprising:

a panel having a repetitive pattern of aligned peaks and valleys, wherein the panel is attachable to a wall with at least one fastener inserted through one or more of the valleys;

a series of ledges associated with the valleys and configured such that at least a portion of each ledge extends beyond adjacent peaks of the aligned peaks and valleys, wherein each ledge is associated with a ledge slot in the valley from which the ledge was formed, and wherein the portion of each ledge extending beyond the adjacent peaks are configured to support a product;

a plurality of first fluid paths defined by spaces between the peaks and the wall; and a plurality of second fluid paths defined by spaces between the valleys and the product.

2. The system of claim 1, wherein each ledge is formed from valley material.

3. The system of claim 2, wherein the panel comprises corrugated sheeting.

4. The system of claim 3, wherein the panel comprises corrugated metal sheeting.

5. The system of claim 4, wherein the ledges are formed by a punching operation.

6. The system of claim 1, further comprising a plurality of third fluid paths defined by a plurality of the ledge slots.

7. The system of claim 1, wherein the product comprises a plurality of veneer products supported by one or more of the ledges and secured to one or more of the peaks.

8. The system of claim 7, wherein the veneer products are secured to the panel with an adhesive.

9. The system of claim 1, further comprising a plurality of edge slots configured to mate with ledges on a second panel to form a smooth transition between adjacent panels.

10. A veneer panel system, comprising:

a panel having a repetitive pattern of aligned peaks and valleys, wherein the panel is attachable to a wall with at least one fastener inserted through one or more of the valleys;

a series of individual ledges associated with the valleys and configured such that at least a portion of each ledge extends beyond adjacent peaks of the aligned peaks and valleys, wherein each ledge is associated with a ledge slot in the valley from which the ledge was formed, and wherein the portions of each ledge extending beyond adjacent peaks are configured to support a veneer product;

a plurality of first fluid paths defined by spaces between the peaks and the wall;

a plurality of second fluid paths defined by spaces between the valleys and the veneer product; and a plurality of third fluid paths defined by a plurality of the ledge slots, wherein the plurality of third fluid paths are transverse to the first and second fluid paths.

11. The system of claim 10, wherein each ledge is formed from valley material.

12. The system of claim 11, wherein the panel comprises corrugated sheeting.

13. The system of claim 11, wherein the panel comprises corrugated metal sheeting.

14. The system of claim 13, wherein the ledges are formed by a punching operation.

15. The system of claim 13, further comprising a coating covering at least a portion of an end of the panel.

16. The system of claim 13, wherein the veneer product comprises thin bricks supported by the ledges and secured to the peaks.

17. The system of claim 16, wherein the thin bricks are secured to the panel with an adhesive.

18. The system of claim 13, further comprising a plurality of edge slots configured to mate with ledges on a second panel to form a smooth transition between adjacent panels.

* * * * *